US008133649B2

(12) United States Patent
McDougall et al.

(10) Patent No.: US 8,133,649 B2
(45) Date of Patent: Mar. 13, 2012

(54) TONER COMPOSITIONS

(75) Inventors: Maria N. V. McDougall, Oakville (CA); Ke Zhou, Oakville (CA); Edward G. Zwartz, Mississauga (CA); Daryl W. Vanbesien, Burlington (CA); John L. Pawlak, Rochester, NY (US); Paul J. Gerroir, Oakville (CA); Suxia Yang, Mississauga (CA); Richard P. N. Veregin, Mississauga (CA); Karen Ann Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 569 days.

(21) Appl. No.: 12/325,396

(22) Filed: Dec. 1, 2008

(65) Prior Publication Data

US 2010/0136472 A1 Jun. 3, 2010

(51) Int. Cl.
*G03G 9/087* (2006.01)

(52) U.S. Cl. ..... 430/109.4; 430/110.1; 430/110.2

(58) Field of Classification Search ..... 430/109.4, 430/110.1, 110.2

See application file for complete search history.

(56) References Cited

U.S. PATENT DOCUMENTS 3,590,000 A 6/1971 Palermiti et al.
3,681,106 A 8/1972 Burns at al.
3,800,588 A 4/1974 Larson et al.
3,847,604 A 11/1974 Hagenbach et al.
4,295,990 A 10/1981 Verbeek et al.
4,298,672 A 11/1981 Lu
4,338,390 A 7/1982 Lu
4,533,614 A 8/1985 Fukumoto et al.
4,657,837 A 4/1987 Morita et al.
4,693,952 A 9/1987 Koizumi et al.
4,814,249 A 3/1989 Oseto et al.
4,845,006 A 7/1989 Matsubara et al.
4,863,824 A 9/1989 Uchida et al.
4,863,825 A 9/1989 Yoshimoto et al.
4,917,983 A 4/1990 Uchida et al.
4,931,370 A 6/1990 Amaya et al.
4,933,252 A 6/1990 Nishikawa et al.
4,935,326 A 6/1990 Creatura et al.
4,937,166 A 6/1990 Creatura et al.
4,957,774 A 9/1990 Doi et al.
4,960,664 A 10/1990 Yamada et al.
4,973,539 A 11/1990 Sacripante et al.
4,980,448 A 12/1990 Tajiri et al.
4,981,939 A 1/1991 Matsumura et al.
4,988,794 A 1/1991 Kubo et al.
5,057,596 A 10/1991 Kubo et al.
5,143,809 A 9/1992 Kaneko et al.
5,227,460 A 7/1993 Mahabadi et al.
5,236,629 A 8/1993 Mahabadi et al.
5,290,654 A 3/1994 Sacripante et al.
5,302,486 A 4/1994 Patel et al.
5,330,874 A 7/1994 Mahabadi et al.
5,346,797 A 9/1994 Kmiecik-Lawrynowicz et al.
5,364,729 A 11/1994 Kmiecik-Lawrynowicz et al.
5,376,494 A 12/1994 Mahabadi et al.
5,403,693 A 4/1995 Patel et al.
5,418,108 A 5/1995 Kmiecik-Lawrynowicz et al.
5,480,756 A 1/1996 Mahabadi et al.

(Continued)

*Primary Examiner* — Hoa Le
(74) *Attorney, Agent, or Firm* — Judith L. Byorick

(57) ABSTRACT

Toner particles are provided which may, in embodiments, include a high molecular weight branched or cross-linked polyester to decrease image gloss and to increase toner elasticity to prevent surface additives impaction. In embodiments, the toner particles may have a core-shell configuration, with the high molecular weight polyester in the core, the shell, or both.

20 Claims, 3 Drawing Sheets

U.S. PATENT DOCUMENTS

| | | | |
|---|---|---|---|
| 5,500,324 | A | 3/1996 | Mahabadi et al. |
| 5,501,935 | A | 3/1996 | Patel et al. |
| 5,527,658 | A | 6/1996 | Hopper et al. |
| 5,585,215 | A | 12/1996 | Ong et al. |
| 5,601,960 | A | 2/1997 | Mahabadi et al. |
| 5,629,121 | A | 5/1997 | Nakayama |
| 5,650,255 | A | 7/1997 | Ng et al. |
| 5,650,256 | A | 7/1997 | Veregin et al. |
| 5,650,484 | A | 7/1997 | Hawkins et al. |
| 5,750,909 | A | 5/1998 | Hawkins et al. |
| 5,853,943 | A | 12/1998 | Cheng et al. |
| 5,962,177 | A | 10/1999 | Sacripante et al. |
| 6,063,827 | A | 5/2000 | Sacripante et al. |
| 6,214,507 | B1 | 4/2001 | Sokol et al. |
| 6,326,119 | B1 | 12/2001 | Hollenbaugh, Jr. et al. |
| 6,358,657 | B1 | 3/2002 | Silence et al. |
| 6,359,105 | B1 | 3/2002 | Ianni et al. |
| 6,365,316 | B1 | 4/2002 | Stamp et al. |
| 6,592,913 | B2 | 7/2003 | Cook et al. |
| 6,593,049 | B1 | 7/2003 | Veregin et al. |
| 6,593,053 | B1 | 7/2003 | Chang et al. |
| 6,756,176 | B2 | 6/2004 | Stegamat et al. |
| 6,830,860 | B2 | 12/2004 | Sacripante et al. |
| 7,335,453 | B2 | 2/2008 | Sacripante et al. |
| 2006/0115758 | A1 * | 6/2006 | Chang et al. ..... 430/109.4 |
| 2006/0222991 | A1 | 10/2006 | Sacripante et al. |
| 2007/0059630 | A1 | 3/2007 | Chen et al. |
| 2007/0134577 | A1 | 6/2007 | Tong et al. |
| 2007/0254228 | A1 | 11/2007 | Farrugia et al. |
| 2007/0254230 | A1 | 11/2007 | Morales-Tirado et al. |
| 2008/0063965 | A1 | 3/2008 | Lai et al. |
| 2008/0090163 | A1 | 4/2008 | Agur et al. |
| 2008/0107990 | A1 | 5/2008 | Field et al. |
| 2008/0113291 | A1 | 5/2008 | Patel |

* cited by examiner

TONER COMPOSITIONS

BACKGROUND

The present disclosure relates to toners suitable for electrophotographic apparatuses.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Polyester EA ultra low melt (ULM) toners have been prepared utilizing amorphous and crystalline polyester resins. While these toners may exhibit excellent fusing properties including crease minimum fixing temperature (MFT) and fusing latitude, peak gloss of these toners may be unacceptably high. These toners may exhibit poor charging characteristics, which may be due to the crystalline resin component migrating to the surface during coalescence, as well as poor toner flow and poor blocking. Improved toners thus remain desirable.

SUMMARY

The present disclosure provides toners and methods for their production. In embodiments, a toner of the present disclosure may include at least one linear polyester, at least one crystalline polyester and at least one high molecular weight polyester having a $M_w$ greater than about 15,000 and a polydispersity index of greater than about 4, wherein the linear polyester and the high molecular weight polyester have a difference in solubility parameter of from about 0.1 to about 1.

In other embodiments, a toner of the present disclosure may include at least one linear polyester resin, at least one crystalline polyester resin, and one or more optional ingredients selected from the group consisting of colorants, optional waxes, and combinations thereof; and at least one high molecular weight polyester having a $M_w$ of from about 20,000 to about 100,000, and a polydispersity index of from about 4 to about 100, wherein the linear polyester and the high molecular weight polyester have a difference in solubility parameter of from about 0.1 to about 1.

Processes of the present disclosure may include, for example, contacting at least one linear resin with at least one crystalline polyester resin in an emulsion comprising at least one surfactant; contacting the emulsion with at least one high molecular weight polyester having a $M_w$ greater than about 15,000 and a polydispersity index of greater than about 4, wherein the linear polyester and the high molecular weight polyester have a difference in solubility parameter of from about 0.1 to about 1, an optional colorant, and an optional wax; aggregating the small particles to form a plurality of larger aggregates; coalescing the larger aggregates to form particles; and recovering the particles.

BRIEF DESCRIPTION OF THE DRAWINGS

Various embodiments of the present disclosure will be described herein below with reference to the figure wherein.

DETAILED DESCRIPTION

Figure 1:
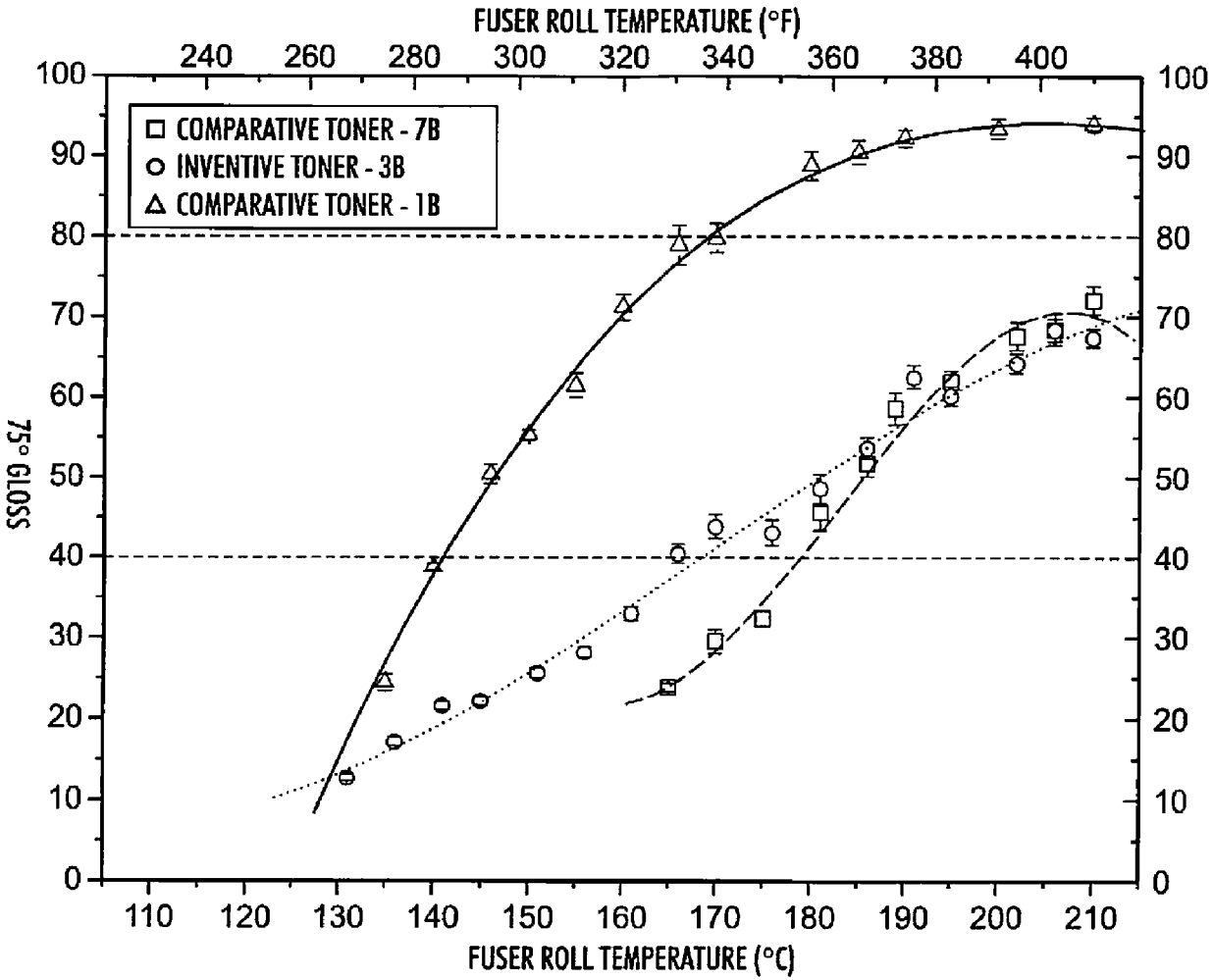
FIG. 1 is a graph depicting gloss values obtained for a toner of the present disclosure produced in the Examples compared with a toner made without a high molecular weight polyester resin and a conventionally extruded control toner.

The present disclosure provides toner particles having desirable charging, flow, blocking, and gloss properties. The toner particles may possess a core-shell configuration, with a branched resin or partially cross-linked resin in the core, shell, or both.

Core Resins

In embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, malonic acid, succinic acid, glutaric acid, adipic acid, pimelic acid, suberic acid, azelaic acid, sebacic acid, undecanedioic acid, dodecanedioic acid, 1,11-undecane dicarboxylic acid, 1,12-dodecane dicarboxylic acid, 1,13-tridecane dicarboxylic acid, 1,14-tetradecane dicarboxlic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(dodecylene-adipate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(dodecylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecandioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copolymers such as copoly(ethylene-fumarate)-copoly(ethylene-dodecandioate) and the like, alkali copoly(5-sulfoisophthaloyl)-copoly(ethylene-adipate), alkali copoly(5-sulfoisophthaloyl)-copoly (propylene-adipate), alkali copoly(5-sulfoisophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), alkali copoly (5-sulfo-isophthaloyl)-copoly(octylene-adipate), alkali copoly (5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly (octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly (5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), poly(propylene-succinimide), and poly (butylene-succinimide).

The crystalline resin may be present, for example, in an amount of from about 5 to about 50 percent by weight of the toner components, in embodiments from about 5 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 2 to about 4.

Examples of diacid or diesters including vinyl diacids or vinyl diesters selected for the preparation of amorphous polyesters include dicarboxylic acids or diesters such as terephthalic acid, phthalic acid, isophthalic acid, fumaric acid, dimethyl fumarate, dimethyl itaconate, cis-1,4-diacetoxy-2-butene, diethyl fumarate, diethyl maleate, maleic acid, succinic acid, itaconic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include poly(styrene-acrylate) resins, cross-linked, for example, from about 10 percent to about 70 percent, poly(styrene-acrylate) resins, poly(styrene-methacrylate) resins, cross-linked poly(styrene-methacrylate) resins, poly(styrene-butadiene) resins, cross-linked poly (styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, cross-linked alkali sulfonated poly(styrene-acrylate) resins, poly(styrene-methacrylate) resins, cross-linked alkali sulfonated-poly(styrene-methacrylate) resins, alkali sulfonated-poly(styrene-butadiene) resins, and cross-linked alkali sulfonated poly(styrene-butadiene) resins. Alkali sulfonated polyester resins may be useful in embodiments, such as the metal or alkali salts of copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly (propylene-butylene-terephthalate)-copoly(propylene-butylene-5-sulfo -isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly (ethoxylated bisphenol-A-5-sulfo-isophthalate), and wherein the alkali metal is, for example, a sodium, lithium or potassium ion.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be a poly (propoxylated bisphenol A co-fumarate) resin having the following formula (I):

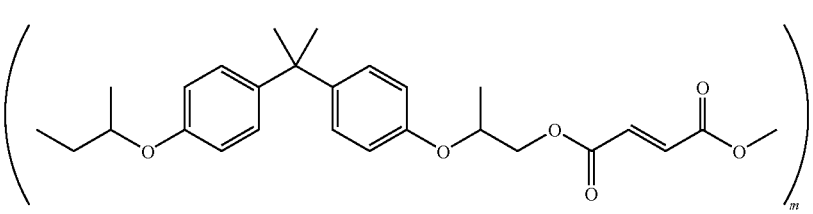

(I)

wherein m may be from about 5 to about 1000.

An example of a linear propoxylated bisphenol A fumarate resin which may be utilized as a latex resin is available under the trade name SPARII™ from Resana S/A Industrias Quimicas, Sao Paulo Brazil. Other suitable linear resins include those disclosed in U.S. Pat. Nos. 4,533,614, 4,957,774 and 4,533,614, which can be linear polyester resins including dodecylsuccinic anhydride, terephthalic acid, and alkyloxylated bisphenol A. Other propoxylated bisphenol A fumarate resins that may be utilized and are commercially available include GTU-FC115, commercially available from Kao Corporation, Japan, and the like.

Suitable crystalline resins include those disclosed in U.S. Patent Application Publication No. 2006/0222991, the disclosure of which is hereby incorporated by reference in its entirety. In embodiments, a suitable crystalline resin may include a resin composed of ethylene glycol and a mixture of dodecanedioic acid and fumaric acid co-monomers with the following formula:

(II)

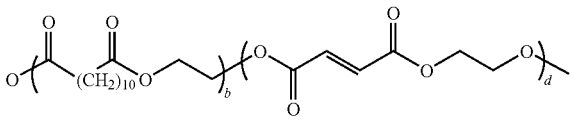

wherein b is from 5 to 2000 and d is from 5 to 2000.

For example, in embodiments, a poly(propoxylated bisphenol A co-fumarate) resin of formula I as described above may be combined with a crystalline resin of formula II to form a core.

In embodiments, the amorphous resin or combination of amorphous resins utilized in the core may have a glass transition temperature of from about 30° C. to about 80° C., in embodiments from about 35° C. to about 70° C. In further embodiments, the combined resins utilized in the core may have a melt viscosity of from about 10 to about 1,000,000 Pa*S at about 130° C., in embodiments from about 50 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by condensation polymerization methods.

High Molecular Weight Resin

In embodiments, the core resins described above may be combined with a high molecular weight branched or cross-linked resin. This high molecular weight resin may include, in embodiments, for example, a branched resin or polymer, a cross-linked resin or polymer, or mixtures thereof, or a non-cross-linked resin that has been subjected to cross-linking. In accordance with the present disclosure, from about 1% by weight to about 100% by weight of the higher molecular weight resin may be branched or cross-linked, in embodiments from about 2% by weight to about 50% by weight of the higher molecular weight resin may be branched or cross-linked. As used herein, the term "high molecular weight resin" refers to a resin wherein the weight-average molecular weight ($M_w$) of the chloroform-soluble fraction of the resin is above about 15,000 and a polydispersity index (PD) above about 4, as measured by gel permeation chromatography versus standard polystyrene reference resins. The PD index is the ratio of the weight-average molecular weight ($M_w$) and the number-average molecular weight ($M_n$).

The high molecular weight polyester resins may prepared by branching or cross-linking linear polyester resins. Branching agents can be utilized, such as trifunctional or multifunctional monomers, which agents usually increase the molecular weight and polydispersity of the polyester. Suitable branching agents can include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539, the disclosures of each of which are incorporated by reference in their entirety.

In embodiments, cross-linked polyesters resins may be made from linear polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference in their entirety. In embodiments, suitable unsaturated polyester base resins may be prepared from diacids and/or anhydrides such as, for example, maleic anhydride, fumaric acid, and the like, and combinations thereof, and diols such as, for example, propoxylated bisphenol A, propylene glycol, and the like, and combinations thereof. In embodiments, a suitable polyester is poly(propoxylated bisphenol A fumarate).

In embodiments, the high molecular weight branched or cross-linked polyester resin has a $M_w$ of greater than about 15,000, in embodiments from about 15,000 to about 1,000,000, in other embodiments from about 20,000 to about 100,000, and a polydispersity index ($M_w/M_n$) of greater than about 4, in embodiments from about 4 to about 100, in other embodiments from about 6 to about 50, as measured by GPC versus standard polystyrene reference resins.

In embodiments, a branched or cross-linked polyester that is not completely compatible with the primary linear resin may be used for the formation of the toner particles. When the Delta Solubility Parameter (ΔSP) between the high molecular weight resin and the linear resin is from about 0.1 to about 1, the high molecular weight resin may be found close to or at the surface of the toner particles. As a result, the surface of the toner may possess higher elasticity and may result in preferred toner performance such as a reduction in additive impaction, improved toner flow during xerographic use and a reduced tendency for toner blocking during transportation and storage, particularly under high temperature and high humidity conditions. In embodiments, the ΔSP may be from about 0.2 to about 0.6.

As used herein, an SP value (solubility parameter) means a value obtained by the Fedors method. The SP value may be defined by the following equation:

$$SP = \sqrt{\frac{\Delta E}{V}} = \sqrt{\frac{\sum_i \Delta ei}{\sum_i \Delta vi}}$$

In the equation, SP represents a solubility parameter, ΔE represents a cohesive energy (cal/mol), V represents mole volume ($cm^3$/mol), Δei represents a vaporization energy of an $i^{th}$ atom or atomic moiety (cal/atom or atomic moiety), Δvi represents a mole volume of an $i^{th}$ atom or atomic moiety ($cm^3$/atom or atomic moiety), and i represents an integer of 1 or more.

The SP value represented by the above equation may be obtained so that its unit becomes $cal^{1/2}/cm^{3/2}$ as a custom, and is expressed dimensionlessly. In addition, since a relative difference in the SP value (ΔSP) between a high molecular weight resin and the linear resin utilized in the formation of a toner is meaningful, the difference in the SP values, ΔSP, is also expressed dimensionlessly.

When the ΔSP value is less than about 0.1, the high molecular weight branched or cross-linked polyester may be too compatible with the linear resin, and thus it may not be near or at the surface of the particle after coalescence. When the ΔSP is greater than about 1, the branched or cross-linked polyester may be rejected and not incorporated into the final particle.

In embodiments, a cross-linked branched polyester may be utilized as a high molecular weight resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference in its entirety.

In embodiments, branched polyesters may include those resulting from the reaction of dimethylterephthalate, 1,3-butanediol, 1,2-propanediol, and pentaerythritol.

Suitable polyols may contain from about 2 to about 100 carbon atoms and have at least two or more hydroxy groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% weight of the reaction mixture, in embodiments, from about 20% to about 26% weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a $C_3$ to $C_6$ cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% weight of the reaction mixture, in embodiments, from about 44% to about 60% weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted napthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

The amount of high molecular weight resin in a toner particle of the present disclosure, whether in the core, the shell, or both, may be from about 1% to about 30% by weight of the toner, in embodiments from about 2.5% to about 20% by weight, or from about 5% to about 10% by weight of the toner.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 110 nanometers to about 150 nanometers. The high molecular weight resin particles may cover from about 10% to about 90% of the toner surface, in embodiments from about 20% to about 50% of the toner surface.

Toner

The resin described above may be utilized to form toner compositions. Such toner compositions may include optional colorants, waxes, and other additives. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites M08029™, M08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991 K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb LI 250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlicb), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and a colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as camauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional colorant, an optional wax and any other desired or required additives, and emulsions including the resins and/or high molecular weight and cross-linked resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a high molecular weight resin latex as described above may be included in the shell. In yet other embodiments, the high molecular weight resin latex described above may be combined with a resin that may be utilized to form the core, and then added to the particles as a resin coating to form a shell.

In embodiments, resins which may be utilized to form a shell include, but are not limited to, a high molecular weight resin latex described above, and/or the amorphous resins described above for use as the core. In embodiments, an amorphous resin which may be utilized to form a shell in accordance with the present disclosure includes an amorphous polyester, optionally in combination with a high molecular weight resin latex described above. For example, in embodiments, an amorphous resin of formula I above may be combined with a cross-linked styrene-n-butyl acrylate resin to form a high molecular weight resin shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the high molecular weight resin latex described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In embodiments, a high molecular weight resin in a shell resin may be able to prevent any crystalline resin in the core from migrating to the toner surface. In addition, the resins in the shell may be less compatible with the crystalline resin utilized in forming the core, which may result in a higher toner glass transition temperature (Tg), and thus improved blocking and charging characteristics may be obtained, including A-zone charging. Moreover, toners of the present disclosure having a high molecular weight resin latex in the core and/or shell may exhibit excellent document offset performance characteristics, as well as reduced peak gloss, in embodiments from about 5 Gardner gloss units (ggu) to about 100 ggu, in other embodiments from about 10 ggu to about 80 ggu, which may be desirable for reproduction of text and images, as some users object to high gloss and the differential which may occur between low gloss and high gloss.

Where the core, the shell, or both includes a branched high molecular weight resin as described above, the presence of the high molecular weight resin may prevent the crystalline resin in the core from migrating to the toner surface. This may especially occur where the high molecular weight resin is present in the shell. In addition, the shell resin(s) may be less compatible with the crystalline resin utilized in forming the core, which may result in a higher toner glass transition temperature (Tg), and thus improved blocking and charging characteristics may be obtained, including A-zone charging. In addition, the high molecular weight resin utilized in the formation of a core-shell particle may have a high viscosity of greater than about 10,000,000 Poise, in embodiments greater than about 50,000,000 Poise, which may be able to prevent any crystalline resin in the core from migrating to the toner surface and thus improve A-zone charging.

In embodiments, the high molecular weight resin utilized in forming the core and/or shell may be present in an amount of from about 2 percent by weight to about 30 percent by weight of the dry toner particles, in embodiments from about 5 percent by weight to about 25 percent by weight of the dry toner particles.

Toner particles possessing a core and or shell possessing a high molecular weight resin as described above may have a glass transition temperature of from about 30° C. to about 80° C., in embodiments from about 35° C. to about 70° C.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat.

No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In other embodiments, a "sol-gel" metal oxide may be used as the high molecular weight resin in accordance with the present disclosure. The sol-gel metal oxide may be produced by a sol-gel process, as compared to one produced by other well-known processes, such as fuming. It has been found that the sol-gel process imparts different properties to the resultant metal oxide product. For example, metal oxides formed by a sol-gel process have been found to be more spherical than metal oxides formed by other processes. Thus, for example, a sol-gel silica may be a silica synthesized by the controlled hydrolysis and condensation of tetraethoxysilane or other suitable starting materials. The sol-gel process may be carried out in alcohol solvents with added homopolymer solutes to control the structure of the precipitated silicon dioxide product. Any suitable sol-gel metal oxide base material can be used. Suitable metal oxides include, but are not limited to, silica, titania, ceria, zirconia, alumina, mixtures thereof, and the like. For example, suitable sol-gel metal oxide products include KEP-10 and KEP-30, both of which are sol-gel silicas available from ESPRIT, Inc. and X24 available from Shin-Etsu Chemical Co.

In embodiments, the sol-gel metal oxide may have a primary particle size of from about 100 nanometers to about 600 nanometers. Because the sol-gel metal oxides typically disperse as primary particles, the penchant for inter-particle cohesion via chain entanglements is minimized. However, in embodiments sol-gel metal oxide materials having sizes outside of these ranges can be used.

In embodiments, toners of the present disclosure may be utilized as ultra low melt (ULM) toners. In embodiments, the dry toner particles having a core and/or shell including the high molecular weight resin of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.9 to about 1, in embodiments from about 0.93 to about 0.98 (measured with, for example, a Sysmex FPIA 2100 analyzer).

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics when exposed to extreme relative humidity (RH) conditions. The low-humidity zone (C-zone) may be about 10° C./15% RH, while the high humidity zone (A-zone) may be about 28° C./85% RH. Toners of the present disclosure may possess a parent toner charge per mass ratio (Q/M) in ambient conditions (B-zone) of about 21° C./50% RH of from about −3 μC/g to about −50 μC/g, in embodiments from about −5 μC/g to about −40 μC/g, and a final toner charging after surface additive blending of from −10 μC/g to about −50 μC/g, in embodiments from about −20 μC/g to about −40 μC/g.

Developers

The toner particles may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

A series of polyesters were synthesized, with a summary of their properties shown in Table 1 below. PE-1 is described in detail below for the preparation of Comparative Toner-1. PE-2 and PE-3 were polycondensation products of terephthalic acid and a 1:1 mixture of ethoxylated bisphenol A (2,2-bis(4-hydroxyphenyl)-propane) and propoxylated bisphenol A that was branched with trimellitic acid. PE-4 was a polycondensation product of isophthalic acid, terephthalic acid, ethoxylated bisphenol A (2,2-bis(4-hydroxyphenyl)-propane), and propoxylated bisphenol A, with trimellitic acid as a branching agent. Cross-linked polyester PE-5 was prepared from PE-1 as described in, for example, U.S. Pat. No. 5,227,460, the disclosure of which is hereby incorporated by reference in its entirety.

TABLE 1

| Resin ID | Type | Solubility Parameter | $M_n$ | $M_p$ | $M_w$ | PD ($M_w/M_n$) |
|---|---|---|---|---|---|---|
| PE-1 | Low $M_w$ Polyester | 9.91 | 4,096 | 7,773 | 13,575 | 3.5 |
| PE-2 | High $M_w$ Polyester | 10.05 | 6,681 | 18,426 | 35,641 | 5.3 |
| PE-3 | High $M_w$ Polyester | 10.11 | 4,235 | 13,297 | 31,882 | 7.4 |
| PE-4 | High $M_w$ Polyester | 10.11 | 7,767 | 15,320 | 27,511 | 4.5 |
| PE-5 | High $M_w$ Polyester | 9.91 | 3,970 | 6,684 | 17,061 | 4.6 |

Solubility parameters were calculated as described by Fedors (Polymer Engineering and Science, February, 1974, Volume 14, No. 2, pages 147-154 and Polymer Engineering and Science, February, 1974, Volume 14, No. 6, page 472). Polymer molecular weights were determined by gel permeation chromatography (GPC) of the chloroform soluble fraction (0.2 micron filter) on an instrument available from Shimadzu Scientific Instruments Corporation using 2 PL Mixed-C columns available from Polymer Laboratories (Varian, Inc.) against polystyrene standards that ranged from 590 to 841,700 g/mol. Values for $M_n$, $M_p$ and $M_w$ were calculated automatically by software available from Polymer Laboratories.

Comparative Example 1

Toner-1

About 397.99 grams of a linear amorphous resin PE-1 in an emulsion (about 17.03 weight % resin) was added to a 2 liter beaker. The linear amorphous resin was of the following formula:

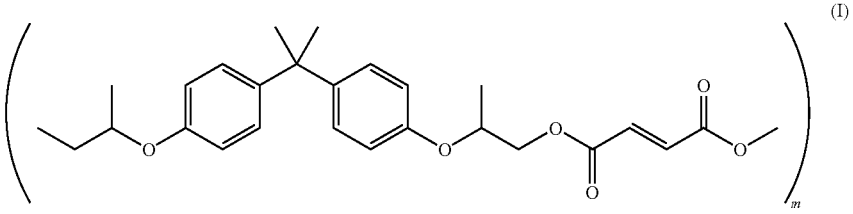

(I)

wherein m was from about 5 to about 1000 and was produced following the procedures described in U.S. Pat. No. 6,063,827, the disclosure of which is hereby incorporated by reference in its entirety. About 74.27 grams of an unsaturated crystalline polyester (UCPE) resin composed of ethylene glycol and a mixture of dodecanedioic acid and fumaric acid co-monomers with the following formula:

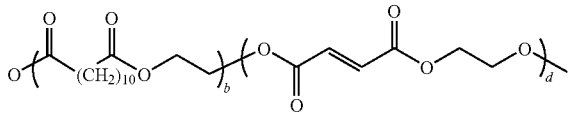

(II)

wherein b is from 5 to 2000 and d is from 5 to 2000 in an emulsion (about 19.98 weight % resin), synthesized following the procedures described in U.S. Patent Application Publication No. 2006/0222991, the disclosure of which is hereby incorporated by reference in its entirety, and about 29.24 grams of a cyan pigment, Pigment Blue 15:3, (about 17 weight %) was added to the beaker. About 36 grams of $A1_2(SO_4)_3$ (about 1 weight %) was added as flocculent under homogenization by mixing the mixture at about 3000 to 4000 rpm. The mixture was subsequently transferred to a 2 liter Buchi reactor, and heated to about 45.9° C. for aggregation and mixed at a speed of about 750 rpm. The particle size was monitored with a Coulter Counter until the size of the particles reached an average volume particle size of about 6.83 μm with a Geometric Size Distribution ("GSD") of about 1.21. About 198.29 grams of PE-1 emulsion was then added to the particles to form a shell thereover, resulting in particles possessing a core/shell structure with an average particle size of about 8.33 μm, and a GSD of about 1.21. Thereafter, the pH of the reaction slurry was increased to about 6.7 by adding NaOH followed by the addition of about 0.45 pph EDTA (based on dry toner) to freeze, that is stop, the toner growth. After stopping the toner growth, the reaction mixture was heated to about 69° C. and kept at that temperature for about 1 hour for coalescence. The resulting toner particles had a final average volume particle size of about 8.07, a GSD of about 1.22, and a circularity of about 0.976. The toner slurry was then cooled to room temperature, separated by sieving (utilizing a 25 μm sieve) and filtered, followed by washing and freeze drying.

Comparative Example 2

Toner-2

Into a 2 liter beaker was added about 128.223 grams of a linear amorphous resin PE-1 emulsion (43.45 wt %), about 48.39 grams of a UCPE resin emulsion (UCPE, 29.76 wt %), about 57.12 grams of a PE-2 emulsion (21.12 wt %) and about 28.53 grams of a cyan pigment (Pigment Blue 15:3) (17.42 wt %). About 35.84 grams of $Al_2(SO_4)_3$ (about 1 wt %) was added in as flocculent under homogenization. The mixture was subsequently transferred to a 2 liter Buchi, and heated to about 45.3° C. for aggregation at about 700 rpm. The particle size was monitored with a Coulter Counter until the core particles reached a volume average particle size of about 7.04 μm with a GSD of about 1.23, and then about 77.72 grams of the above PE-1 resin emulsion was added as shell, resulting in a core-shell structured particles with an average particle size of about 8.33 microns, and a GSD of about 1.21. Thereafter, the pH of the reaction slurry was then increased to about 7.15 using NaOH to freeze the toner growth. After freezing, the reaction mixture was heated to about 69.1° C. for coalescence. The toner had a final particle size of about 8.87 microns and GSD of about 1.25. The toner slurry was then cooled to room temperature, separated by sieving (25 μm), filtration, followed by washing and freeze dried.

Comparative Examples 3 and 4

Toner-5 and Toner-6

Toner-5 and Toner-6 were made as described for Toner-1 in Comparative Example 1 above.

Comparative Example 5

Toner-7

Toner-7 was made by a conventional melt-mix extrusion process from a mixture of about 70% polyester resin PE-1 and about 30% cross-linked polyester resin PE-5, that had been made via a reactive extrusion process as described in U.S. Pat. Nos. 5,227,460, 5,376,494, 5,601,960, 6,359,105.

Example 1

Preparation of a high molecular weight resin emulsion. About 919 grams of ethyl acetate and about 125 grams of high $M_w$ polyester resin PE-2 were added to a 2 liter beaker. The mixture was mixed at a speed of about 250 rpm and heated to about 67° C. to dissolve the resin and initiator in the ethyl acetate, thereby forming a resin solution. About 3.05 grams of sodium bicarbonate and about 1.34 grams (about 46.8 weight %) of DOWFAX was added to a 4 liter Pyrex glass flask reactor containing about 708 grams of deionized water and heated to about 67° C., thereby forming a water solution. Homogenization of the water solution in the 4 liter glass flask reactor was commenced using an IKA Ultra Turrax T50 homogenizer by mixing the mixture at about 4000 rpm. The heated resin solution was thereafter poured slowly into the water solution as the mixture continued to be homogenized and the homogenizer speed was increased to about 10,000 rpm for about 30 minutes. After homogenization was complete, the glass flask reactor and its contents were placed in a heating mantle and connected to a distillation device. The mix was stirred at about 300 rpm and the temperature of the mixture was increased to about 80° C. at about 1° C. per minute to distill off the ethyl acetate from the mixture. The mixture was stirred at about 80° C. for another 120 minutes and thereafter cooled at about 2° C. per minute to room temperature. The product was then screened through a 20 micron sieve. The resulting resin emulsion included about 18 weight % solids in water, and particles in the emulsion had a volume average diameter of about 151 nanometers as measured by a Honeywell Microtrac® UPA 150 particle size analyzer.

Example 2

Toner-3

Preparation of toner particles having about 10% PE-3 high molecular weight resin in the toner core. About 379.99 grams of an emulsion of linear amorphous resin PE-1 (about 17.02 weight % resin) was introduced into a 2 liter beaker. To this, about 78.27 grams of PE-3 emulsion (about 18 weight % resin), about 96.72 grams of an emulsion of the UCPE resin of formula II (about 17.9 weight % resin), and about 39.72 grams of a cyan pigment, Pigment Blue 15:3, (about 14.6 weight %) was added to the beaker. About 41.82 grams of $Al_2(SO_4)_3$ (about 1 weight %) was added as a flocculent under homogenization by mixing at about 3000 to about 4000 rpm. The mixture was subsequently transferred to a 2 liter Buchi reactor, and heated to about 43° C. for aggregation and mixed at a speed of about 700 rpm. The particle size was monitored with a Coulter Counter until the core particles reached a volume average particle size of about 6.83 μm with a GSD of about 1.25. About 230.32 grams of an emulsion of PE-1 (about 17.02 weight % resin) was then added to the particles to form a shell thereover, resulting in particles possessing a core/shell structure with an average particle size of about 8.96 μm, and a GSD of about 1.21. Thereafter, the pH of the reaction slurry was increased to about 6.75 by adding NaOH to stop toner growth. The reaction mixture was then heated to about 80° C. and kept at that temperature for about 1 hour for coalescence. The resulting toner particles had a final average volume particle size of about 8.77 μm, and a GSD of about 1.23. The toner slurry was then cooled to room temperature, separated by sieving (utilizing a 25 μm sieve) and filtered, followed by washing and freeze drying.

Example 3

Toner-4

Toner-4, having about 10% PE-4 high molecular weight resin in the toner core, was prepared as described in Example 2.

Results and Discussion

A summary of toner properties is shown in Table 2 below.

TABLE 2

| Toner ID | Example Type | Toner Type | Low $M_w$ Resin | High $M_w$ Resin | Delta Solubility Parameter | Parent Toner Appearance |
|---|---|---|---|---|---|---|
| Toner-1 | Comparative | Parent | PE-1 | None | NA | Smooth |
| Toner-2 | Comparative | Parent | PE-1 | PE-2 | 0.14 | Smooth |
| Toner-3 | Inventive | Parent | PE-1 | PE-3 | 0.20 | 100-200 micron Particulates |
| Toner-4 | Inventive | Parent | PE-1 | PE-4 | 0.20 | 100-200 micron Particulates |
| Toner-5 | Comparative | Parent | PE-1 | None | NA | Smooth |
| Toner-6 | Comparative | Parent | PE-1 | None | NA | Smooth |
| Toner-7 | Comparative | Parent | PE-1 | PE-5 | 0.00 | Smooth |

Parent toners were surface additive blended with small particle, hydrophobically treated fumed silica and titania and zinc stearate as is described in Example 9 of U.S. Pat. No. 6,365,316 and optionally with about 0.9% X24 by weight of parent toner (X24 is a large particle sol-gel silica commercially available from Shinetsu Chemical Co. Ltd.). The summaries for these toners are set forth below in Table 3 (the "B", for example, of "Toner-1B", means one blended with additives.)

TABLE 3

| Toner ID | Example Type | Toner Type | X24 Silica | Blended Toner Appearance |
|---|---|---|---|---|
| Toner-1B | Comparative | Additive Blended | None | <50 micron particulates |
| Toner-2B | Comparative | Additive Blended | None | <50 micron particulates |
| Toner-3B | Inventive | Additive Blended | None | 100-200 micron Particulates |
| Toner-4B | Inventive | Additive Blended | None | 100-200 micron Particulates |
| Toner-5B | Comparative | Additive Blended | None | <50 micron particulates |
| Toner-6B | Comparative | Additive Blended | Yes | 100-200 micron Particulates |
| Toner-7B | Comparative | Additive Blended | None | <50 micron particulates |

Particle Surface Appearance

Examination of the surface characteristics of the parent and blended toners was done using a Jeol 6300F scanning electron microscope (SEM). This showed the parent toners to be substantially smooth, with little particulate appearance on the surfaces prior to additive blending. Subsequent to blending, comparative blend toners Toner-1B, Toner-2B, Toner-5B and Toner-7B all looked very similar with only small particles of less than about 50 microns evident on the surface. Inventive toners Toner-3B and Toner-4B looked very similar to comparative toner Toner-6B, which had been additive blended with X24, an inorganic sol-gel silica particle designed to improve xerographic aging properties, as is disclosed in U.S. Patent Publication No. 2007/0254230. SEM micrographs of Toner-3B, Toner-4B and comparative Toner-6B all showed spherical particles of about 140 nm average size.

It is believed that the high molecular weight polyester resin of the present disclosure, with the specified solubility parameter difference relative to the low molecular weight polyester resin, migrated to the surface during the coalescence step of particle formation, resulting in small particulates that were attached to the main particle in a similar fashion as when a large particle spacer such as X24 sol-gel silica was used as a surface additive in a blending operation. Thus, toners of the present disclosure have the potential for reduced cost and improved ease of toner processing during additive blending.

Gloss

Machine fusing characteristics of a toner of the invention (Toner-3B), comparative EA toner without any high molecular weight polyester resin (Toner-1B) and a conventionally extruded control toner (Toner-7B) were simulated by performing a temperature sweep and measuring the resulting gloss using a fusing fixture apparatus. As shown in FIG. 1, print gloss (Gardner gloss units or "ggu") was measured using a 75° BYK Gardner gloss meter for toner images that were fused at a fixed toner per unit area on Xerox Digital Color Elite Gloss paper. As is seen in FIG. 1, comparative toner Toner-1B exhibited peak gloss of greater than about 90 ggu. Toners made in this fashion had unacceptably high gloss for many market applications, for example those aimed at the production of photographic quality graphic art marketing collaterals. For example, a replacement toner for Toner-7B would have to match the gloss characteristics of the control toner currently demanded by the market place, and in addition the Gloss would have to be tuned to different levels by toner design. It is apparent from FIG. 1 that the addition of high molecular weight resin of the invention is an effective means to control gloss.

Charging Performance

Charging characteristics were determined by testing developers made by combining about 4.5 grams of toner with about 100 grams of carrier (65 micron steel core, Hoeganaes Corporation) coated with about 1% by weight of polymethylmethacrylate. The developers were placed in a glass jar and mixed using a paint shaker at about 715 cycles per minute under the specified conditions of time, temperature and relative humidity. The results are set forth in FIGS. 2 and 3, which includes plots comparing the charging of the toners of the present disclosure (Toner-3B) with comparative toners Toner-5B (no high $M_w$ polyester resin) and Toner-6B (as Toner-5B, but blended with external additive X24). Low-humidity tests (C-Z) were done at about 10° C. and about 15% RH, while the high humidity tests (A-Z) were done at about 28° C. and about 85% RH.

Figure 2:
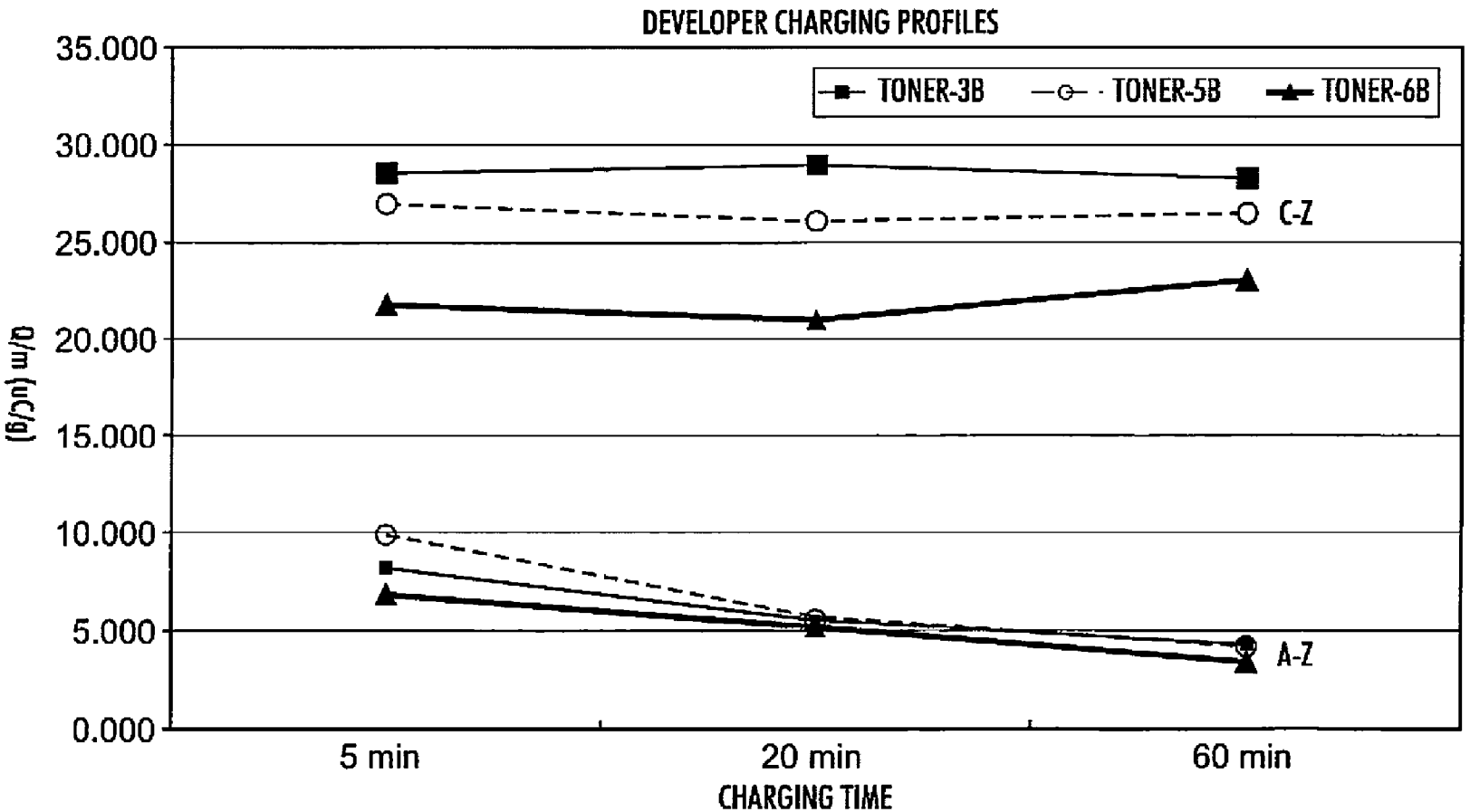
FIG. 2 is a graph comparing the charging (in both A-zone and C-zone) of toners of the present disclosure with a control and comparative toner.

As illustrated in FIG. 2, inventive toner Toner-3B was quite similar to the control toners that did not contain high molecular weight polyester resin for preferred gloss performance. Under high humidity, high temperature conditions (A-Z) that disfavor triboelectification of the toner against the carrier, inventive toner Toner-3B showed essentially the same charge as the control toners. Under low humidity, low temperature conditions (C-Z) that favor triboelectrification, inventive Toner-3B showed slightly greater charge and less charge movement over time than the comparative toners. Thus, from the standpoint of triboelectrification, toners of the present disclosure with high molecular weight polyester resin provided equivalent performance to conventional toners and improved charging versus a comparative toner made with an expensive large particle inorganic spacer that was known to give improved developer aging properties due to reduced additive impaction during machine use.

Toner Flow

It is desirable to have a toner with low cohesion to enable effective toner flow. Inventive and comparative toners were tested in a Hosokawa Powder Flow Tester by using a set of 53 (A), 45 (B) and 38 (C) micron screens stacked together, with the weight of the screens recorded before adding to the top screen about 2 grams of toner, with the vibration time set to 90 seconds at about 1 mm vibration. After vibration, the screens were removed and weighed to determine the weight of toner (weight after−weight before=weight retained toner). % Cohesion was calculated by the following formula:

$$\%\text{Cohesion}=(R_1/T_i)\times 100\%+(R_2/T_i)\times 60\%+(R_3/T_i)\times 20\%$$

wherein $R_1$, $R_2$ and $R_3$ are the amounts of toner retained in screens A, B and C, respectively, and $T_i$ is the initial amount of toner.

Figure 3:
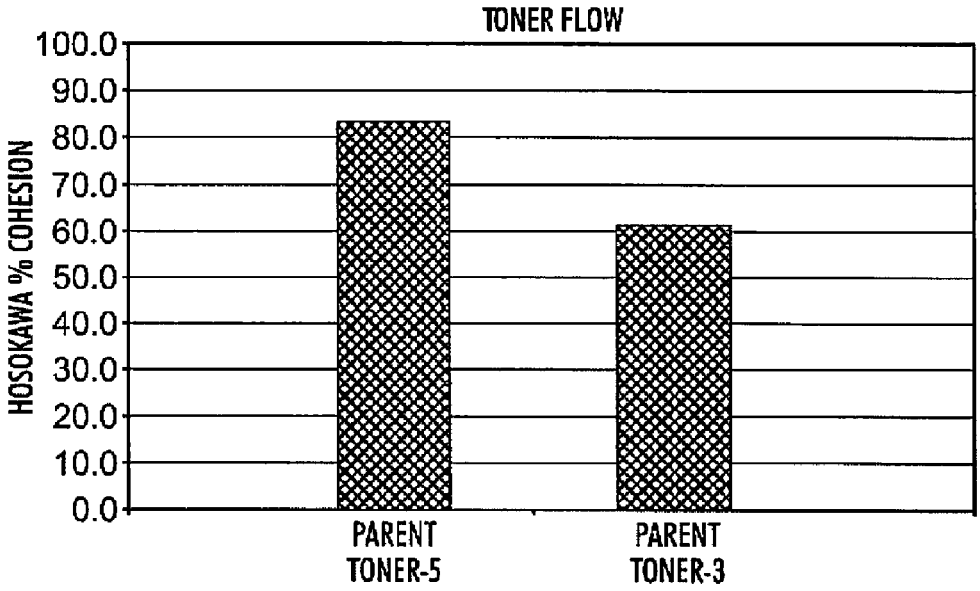
FIG. 3 is a graph comparing the flow properties and cohesion of a toner of the present disclosure with a high molecular weight resin in the core, a control toner and comparative toner.

As is seen in FIG. 3, it was observed that the addition of the high molecular weight resin as described above in Example 2 provided a desirable toner with low cohesion, i.e. decreased particle to particle cohesion. For example, inventive parent Toner-3 was much less cohesive than comparative parent Toner-5. That is, the toner flow properties of toners of the invention were superior to the prior art toner.

Toner Blocking

It is desirable to have a toner with effective blocking performance. Blocking was assessed by heating about 5 grams of toner for about 20 hours at about 50% RH at a temperature of from about 54° C. to about 59° C., followed by testing the toner flow on Hosokawa Powder Flow Tester. After heating, a larger 1000 micron (Screen D) and 106 micron (screen E) were stacked together, with about the 5 grams of toner poured onto the top screen, exposed to heat and, after cooling, a vibration time set to 90 seconds at about 1 mm vibration. The screen weight was recorded before and after the test, the blocking % Cohesion was calculated as: % Cohesion=$[(R_4+R_5)/T_i]\times 100\%$ wherein $R_4$ and $R_5$ are the amounts of toner retained in screens D and E, respectively, and $T_i$ is the initial amount of toner. A low % Cohesion result indicated excellent toner blocking performance, while a high % Cohesion result indicated poor toner blocking performance.

Figure 4:
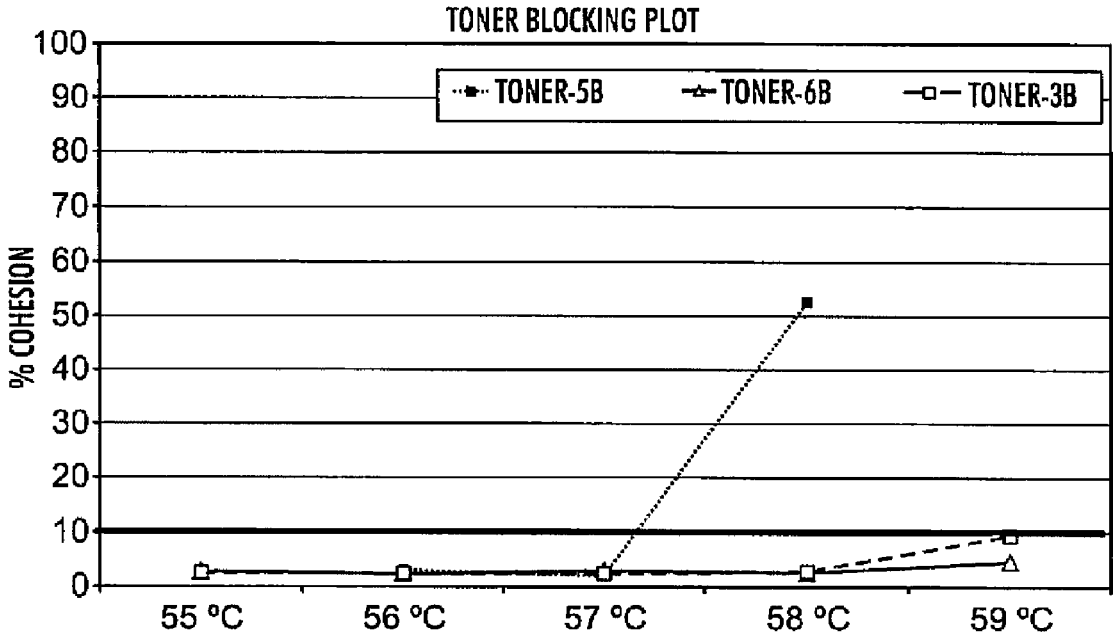
FIG. 4 is a graph depicting toner blocking properties and cohesion of a toner of the present disclosure with a high molecular weight resin in the core, a control toner and comparative toner.

As illustrated in FIG. 4, it was observed that the addition of the high molecular weight resin in a toner of the present disclosure provided a desirable toner with low blocking. For example, inventive Toner-3B showed essentially no blocking up to a temperature of about 59° C., which was similar to comparison Toner-6B with the expensive inorganic large particle silica additive and much improved over comparative Toner-5B made without the addition of high $M_w$ polyester resin. This would be especially important for adequate performance of toners that may have been subjected to stress conditions on hot and humid days during toner transportation and distribution.

Thus, to summarize, toners of the present disclosure enabled effective gloss control, provided excellent triboelectrification properties, while also giving preferred toner flow and blocking characteristics relative to comparative toners without any added high molecular weight resin. The formation of particulates on the surface of the parent toner is thought to be key to the improvements seen with respect to flow and blocking, and this property was demonstrated to relate to a solubility parameter difference of from about 0.1 to about 1 between the main polyester resin and the high molecular weight polyester resin.

Interestingly, it was found that the gloss could be effectively controlled without any deleterious impact on charging levels. It was also found that the incorporation of the branched polyester high molecular weight resin provided both improved cohesion and blocking performance of the inventive toners without the need to use expensive inorganic particles for the same purpose.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

at least one linear polyester;

at least one crystalline polyester; and at least one branched high molecular weight polyester having a $M_w$ greater than about 15,000 and a polydispersity index of greater than about 4, wherein the linear polyester and the high molecular weight polyester have a difference in solubility parameter of from about 0.1 to about 1, wherein at least a portion of the branched polyester is located on the surface as particles having a diameter of from about 100 nanometers to about 300 nanometers, and wherein the particles cover from about 10% to about 90% of the toner surface.

2. The toner according to claim 1, wherein the at least one linear resin comprises a polyester selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and wherein the at least one crystalline resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(dodecylene-adipate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(dodecylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecandioate), poly(decylene-dodecandioate), poly(undecylene-dodecandioate), poly(dodecylene-dodecandioate), poly (ethylene-fumarate), poly(propylene-fumarate), poly (butylene-fumarate), poly(pentylene-fumarate), poly (hexylene-fumarate), poly(octylene-fumarate), poly (nonylene-fumarate), poly(decylene-fumarate), copoly (ethylene-fumarate)-copoly(ethylene-dodecandioate), alkali copoly(5-sulfoisophthaloyl)-copoly (ethylene-adipate), alkali copoly(5-sulfoisophthaloyl)-copoly (propylene-adipate), alkali copoly(5-sulfoisophthaloyl)-copoly (butylene-adipate), alkali copoly(5-sulfo-isophthaloyl)-copoly (pentylene-adipate), alkali copoly (5-sulfo-isophthaloyl)-copoly (hexylene-adipate), alkali copoly(5-sulfo-isophthaloyl)-copoly (octylene-adipate), alkali copoly(5-sulfo-isophthaloyl)-copoly (ethylene-adipate), alkali copoly(5-sulfo-isophthaloyl)-copoly (propylene-adipate), alkali copoly(5-sulfo-isophthaloyl)-copoly (butylene-adipate), alkali copoly (5-sulfo-isophthaloyl)-copoly (pentylene-adipate), alkali copoly(5-sulfo-isophthaloyl)-copoly (hexylene-adipate), alkali copoly(5-sulfo-isophthaloyl)-copoly (octylene-adipate), alkali copoly(5-sulfoisophthaloyl)-copoly (ethylene-succinate), alkali copoly(5-sulfoisophthaloyl)-copoly (propylene-succinate), alkali copoly(5-sulfoisophthaloyl)-copoly (butylenes-succinate), alkali copoly(5-sulfoisophthaloyl)-copoly (pentylene-succinate), alkali copoly(5-sulfoisophthaloyl)-copoly (hexylene-succinate), alkali copoly(5-sulfoisophthaloyl)-copoly (octylene-succinate), alkali copoly(5-sulfo-isophthaloyl)-copoly (ethylene-sebacate), alkali copoly(5-sulfo-isophthaloyl)-copoly (propylene-sebacate), alkali copoly(5-sulfo-isophthaloyl)-copoly (butylene-sebacate), alkali copoly(5-sulfo-isophthaloyl)-copoly (pentylene-sebacate), alkali copoly(5-sulfo-isophthaloyl)-copoly (hexylene-sebacate), alkali copoly(5-sulfo-isophthaloyl)-copoly (octylene-sebacate), alkali copoly(5-sulfo-isophthaloyl)-copoly (ethylene-adipate), alkali copoly(5-sulfo-isophthaloyl)-copoly (propylene-adipate), alkali copoly (5-sulfo-isophthaloyl)-copoly (butylene-adipate), alkali copoly(5-sulfo-isophthaloyl)-copoly (pentylene-adipate), alkali copoly(5-sulfo-isophthaloyl)-copoly (hexylene-adipate), and wherein the alkali comprises a metal selected from the group consisting of sodium, lithium and potassium.

3. The toner according to claim 1, wherein the toner particles comprise a core with a shell thereover, and wherein the high molecular weight polyester is present in an amount of from about 1% to about 30% by weight of the toner.

4. The toner according to claim 1, wherein the toner particles comprise a core with a shell thereover, and wherein the high molecular weight polyester is present in both the core and the shell.

5. The toner according to claim 1, wherein the toner particles comprise a core with a shell thereover, and wherein the high molecular weight polyester is present in the core in an amount of from about 5% to about 25% by weight of the toner.

6. A toner comprising:

at least one linear polyester;

at least one crystalline polyester; and at least one high molecular weight polyester having a $M_w$ greater than about 15,000 and a polydispersity index of greater than about 4, wherein the linear polyester and the high molecular weight polyester have a difference in solubility parameter of from about 0.1 to about 1, wherein the at least one linear resin comprises a poly(propoxylated bisphenol A co-fumarate) resin of the formula:

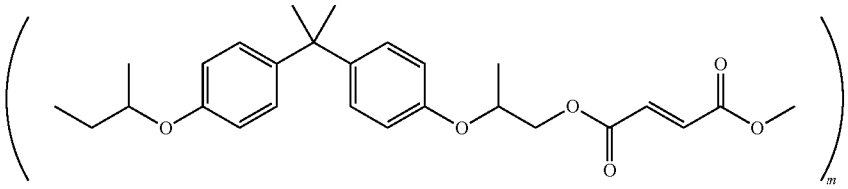

wherein m is from about 5 to about 1000, wherein the at least one crystalline resin is of the formula:

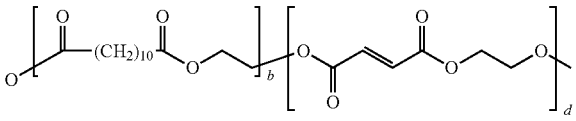

wherein b is from 5 to 2000 and d is from 5 to 2000.

7. The toner according to claim 1, wherein from about 1% by weight to about 100% by weight of the high molecular weight polyester is cross-linked, and wherein the high molecular weight polyester is present in an amount of from about 1% to about 30% by weight of the other resins utilized to form the toner.

8. The toner according to claim 1, wherein the toner particles are of a size of from about 3 μm to about 25 μm, possess a toner charge per mass ratio of from about −10 μC/g to about −50 μC/g at 21° C./50% RH, and possess a gloss after fusing of from about 5 ggu to about 80 ggu.

9. The toner according to claim 6, wherein the high molecular weight polyester is branched, wherein at least a portion of the branched polyester is located on the surface as particles having a diameter of from about 100 nanometers to about 300 nanometers, and wherein the particles cover from about 10% to about 90% of the toner surface.

10. The toner according to claim 1, wherein the at least one high molecular weight polyester has a $M_w$ of from about 20,000 to about 100,000, and a polydispersity index of from about 4 to about 100.

11. The toner according to claim 6, wherein the toner particles comprise a core with a shell thereover, and wherein the high molecular weight polyester is present in the core, the shell, or both.

12. The toner according to claim 6, wherein from about 1% by weight to about 100% by weight of the high molecular weight polyester is cross-linked, and wherein the high molecular weight polyester is present in an amount of from about 1% to about 30% by weight of the other monomers utilized to form the toner.

13. The toner according to claim 6, wherein the toner particles are of a size of from about 3 μm to about 25 μm, possess a toner charge per mass ratio of from about −10 μC/g to about −50 μC/g at 21° C./50% RH, and possess a gloss after fusing of from about 5 ggu to about 80 ggu.

14. The toner according to claim 6 wherein at least a portion of the high molecular weight polyester is located on the surface as particles having a diameter of from about 100 nanometers to about 300 nanometers, and wherein the particles cover from about 10% to about 90% of the toner surface.

15. A process comprising:

contacting at least one linear resin with at least one crystalline polyester resin in an emulsion comprising at least one surfactant;

contacting the emulsion with at least one high molecular weight polyester having a $M_w$ greater than about 15,000 and a polydispersity index of greater than about 4, wherein the linear polyester and the high molecular weight polyester have a difference in solubility parameter of from about 0.1 to about 1, an optional colorant, and an optional wax;

aggregating the small particles to form a plurality of larger aggregates;

coalescing the larger aggregates to form particles; and recovering the particles, wherein the high molecular weight polyester is branched, wherein at least a portion of the branched polyester is located on the surface as particles having a diameter of from about 100 nanometers to about 300 nanometers, and wherein the particles cover from about 10% to about 90% of the toner surface.

16. The process according to claim 15, wherein the at least one linear resin comprises a polyester selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and the at least one crystalline resin comprises a polyester selected from the group consisting of poly(ethylene-adipate), poly(propylene-adipate), poly(butylene-adipate), poly(pentylene-adipate), poly (hexylene-adipate), poly(octylene-adipate), poly(nonylene-adipate), poly(decylene-adipate), poly(undecylene-adipate), poly(dodecylene-adipate), poly(ethylene-succinate), poly (propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(dodecylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly (pentylene-dodecanedioate), poly(hexylene-dodecanedioate), poly(octylene-dodecanedioate), poly (nonylene-dodecandioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly (nonylene-fumarate), poly(decylene-fumarate), copoly(ethylene-fumarate)-copoly(ethylene-dodecandioate) alkali copoly(5-sulfoisophthaloyl)-copoly (ethylene-adipate), alkali copoly(5-sulfoisophthaloyl)-copoly (propylene-adipate), alkali copoly(5-sulfoisophthaloyl)-copoly (butylene-adipate), alkali copoly(5-sulfo-isophthaloyl)-copoly (pentylene-adipate), alkali copoly(5-sulfo-isophthaloyl)-copoly (hexylene-adipate), alkali copoly(5-sulfo-isophthaloyl)-copoly (octylene-adipate), alkali copoly(5-sulfo-isophthaloyl)-copoly (ethylene-adipate), alkali copoly(5-sulfo-isophthaloyl)-copoly (propylene-adipate), alkali copoly(5-sulfo-isophthaloyl)-copoly (butylene-adipate), alkali copoly(5-sulfo-isophthaloyl)-copoly (pentylene-adipate), alkali copoly(5-sulfo-isophthaloyl)-copoly (hexylene-adipate), alkali copoly(5-sulfo-isophthaloyl)-copoly (octylene-adipate), alkali copoly(5-sulfo-isophthaloyl)-copoly (ethylene-succinate), alkali copoly(5-sulfoisophthaloyl)-copoly (propylene-succinate), alkali copoly(5-sulfoisophthaloyl)-copoly (butylenes-succinate), alkali copoly(5-sulfoisophthaloyl)-copoly (pentylene-succinate), alkali copoly (5-sulfoisophthaloyl)-copoly (hexylene-succinate), alkali copoly (5-sulfoisophthaloyl)-copoly (octylene-succinate), alkali copoly (5-sulfo-isophthaloyl)-copoly (ethylene-sebacate), alkali copoly (5-sulfo-isophthaloyl)-copoly (propylene-sebacate), alkali copoly (5-sulfo-isophthaloyl)-copoly (butylene-sebacate), alkali copoly (5-sulfo-isophthaloyl)-copoly (pentylene-sebacate), alkali copoly (5-sulfo-isophthaloyl)-copoly (hexylene-sebacate), alkali copoly (5-sulfo-isophthaloyl)-copoly (octylene-sebacate), alkali copoly (5-sulfo-isophthaloyl)-copoly (ethylene-adipate), alkali copoly (5-sulfo-isophthaloyl)-copoly (propylene-adipate), alkali copoly (5-sulfo-isophthaloyl)-copoly (butylene-adipate), alkali copoly (5-sulfo-isophthaloyl)-copoly (pentylene-adipate), alkali copoly (5-sulfo-isophthaloyl)-copoly (hexylene-adipate), and wherein alkali comprises a metal selected from the group consisting of sodium, lithium and potassium.

17. The process according to claim 15, further comprising contacting the small particles with the high molecular weight polyester to form a resin coating over the small particles prior to coalescing the small particles.

18. The process according to claim 15, wherein from about 1% by weight to about 100% by weight of the high molecular weight polyester is cross-linked, and wherein the high molecular weight polyester is present in an amount of from about 1% to about 30% by weight of the other monomers utilized to form the toner.

19. The process according to claim 15, wherein the at least one linear resin comprises a poly(propoxylated bisphenol A co-fumarate) resin of the formula:

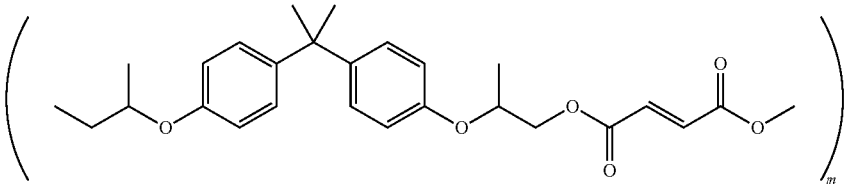

wherein m is from about 5 to about 1000, wherein the at least one crystalline resin is of the formula:
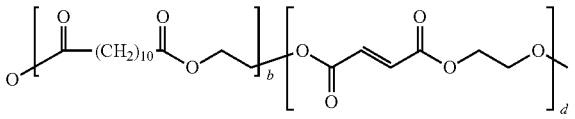
wherein b is from 5 to 2000 and d is from 5 to 2000.
20. The process according to claim 15, wherein the at least one high molecular weight polyester has a $M_w$ of from about 20,000 to about 100,000, and a polydispersity index of from about 4 to about 100.
* * * * *